US005921710A

United States Patent [19]

Scales

[11] Patent Number: 5,921,710

[45] Date of Patent: Jul. 13, 1999

[54] REVETMENT BLOCKS AND METHOD

[76] Inventor: John M. Scales, 6347 Rosecommon Dr., Norcross, Ga. 30092

[21] Appl. No.: 08/807,093

[22] Filed: Feb. 27, 1997

[51] Int. Cl.[6] ..... E02B 3/12

[52] U.S. Cl. ..... 405/20; 404/35; 404/40; 404/41; 405/16; 405/19; 52/608; 52/609

[58] Field of Search ..... 405/284–287, 405/262, 273, 272; 404/35, 37, 41, 40, 34, 42; 52/606, 607, 604, 608, 609

[56] References Cited

U.S. PATENT DOCUMENTS

| | | | |
|---|---|---|---|
| 1,144,143 | 6/1915 | McGillivray . | |
| 1,173,879 | 2/1916 | Shearer . | |
| 1,822,602 | 8/1931 | Ross . | |
| 1,939,417 | 12/1933 | Schulz . | |
| 2,674,856 | 4/1954 | Louckers | 405/20 |
| 2,876,628 | 3/1959 | Dixon, Jr. . | |
| 3,347,048 | 10/1967 | Brown et al. . | |
| 3,379,017 | 4/1968 | Kusatake . | |
| 4,201,494 | 5/1980 | Crowe | 405/17 |
| 4,227,829 | 10/1980 | Landry, Jr. | 405/20 |
| 4,370,075 | 1/1983 | Scales | 405/20 |
| 4,372,705 | 2/1983 | Atkinson | 405/19 |
| 4,436,447 | 3/1984 | Crowe | 405/16 |
| 4,499,664 | 2/1985 | Scales | 29/714 |
| 4,564,311 | 1/1986 | Scales | 405/20 |
| 4,781,492 | 11/1988 | Shindo | 405/16 |
| 5,484,230 | 1/1996 | Rudloff | 404/41 X |

OTHER PUBLICATIONS

Armortec Incorporated brochure Aromorflex® Erosion Control Systems, 4pgs., 1984.

Waterway Technology Corporation brochure Protec® Erosion Control System, 12pgs, 1990.

*Primary Examiner*—Dennis L. Taylor

*Attorney, Agent, or Firm*—Kennedy, Davis & Kennedy

[57] ABSTRACT

The revetment mat comprises at least two webs joined together at aligned perimeter edges. Each web comprises a plurality of (a) interior blocks disposed side-by-side in rows and (b) a plurality of edge blocks defining a pair of perimeter edge rows of the web. The interior and edge blocks are interlinked together by threading a revetment cable through tunnels defined in the blocks. Each of the edge blocks defines a recess in one end thereof and further defines a pair of coaxial bores which extend from a first side to an interior face in the recess and from an opposing face in the recess to a second side of the edge block. An elongated rod is received in the bores and thereby extends across a gap in the recess between the opposing interior faces. A plurality of couplers are used to join a first web to a second web, which webs are positioned side-by-side. Each coupler is disposed within one of the recesses. The couplers are received on the elongated rods in recesses of the respective aligned edge blocks of the webs. Each of the couplers joins at least a portion of the first and second webs together along the aligned edges.

20 Claims, 3 Drawing Sheets

REVETMENT BLOCKS AND METHOD

TECHNICAL FIELD

The present invention relates generally to precast blocks for use in revetment mats for stabilization of the banks of waterways. More particularly, the present invention relates to precast blocks and revetment mats formed therewith which mats are joined together along aligned perimeter edges, for stabilization of the banks of waterways.

BACKGROUND OF THE INVENTION

Banks of waterways such as streams, rivers, channels, canals, and the like, often are covered with revetment to stabilize the bank or to sustain the bank against erosion by water waves, current, and/or wind. The revetment generally comprises a facing of stone, rock, or concrete. Typically, the concrete is in the form of precast blocks. The precast blocks typically mechanically interlock to create a stable revetment on a surface of the banks of waterways to protect the banks from erosion. Often the blocks are interconnected with revetment cables to form an articulatable mat. The revetment cables permit the revetment mat to conform to the contours of the bank surface, while keeping the blocks closely together. Generally, the mats are narrow ribbons of several substantially parallel rows that extend for a predetermined distance to cross from one bank to the opposite bank of a waterway. A plurality of mats are placed side-by-side on the bank to provide protection against erosion along a length of the waterway.

Adjacent mats can be interconnected along aligned perimeter edges. Interconnection of adjacent mats restrains the mats from dislodgement along the aligned edges of the mats in the revetment. Adjacent mats are connected together by connecting a strap, loop, or connector to the revetment cables in the adjacent blocks of the adjacent mats.

While revetment mats have met with success in controlling erosion, the installation of revetment mats and interconnection of adjacent revetment mats is time consuming and labor intensive. For example, threading a revetment cable through the blocks while also aligning a connector onto the cable as it passes between adjacent blocks is difficult. Blocks placed closely adjacent in one mat may interfere with inserting or attaching a cable or connector for joining the mat to an adjacent mat.

Accordingly, there remains a need in the art for improved revetment blocks for assembling into mats to be joined to other such mats along aligned perimeter edges. It is to the provision of such that the present invention is directed.

SUMMARY OF THE PRESENT INVENTION

The present invention solves the need in the art by providing cast blocks for assembling into revetment mats which are readily connected along aligned perimeter edges to adjacent mats. The revetment mat comprises at least two webs joined together at aligned perimeter edges. Each web comprises a plurality of (a) interior blocks disposed side-by-side in rows and (b) a plurality of edge blocks defining a pair of perimeter edge rows of the web. The interior and edge blocks are interlinked together by threading a revetment cable through tunnels defined in the blocks. Each of the edge blocks defines a recess in one end thereof and further defines a pair of coaxial bores which extend from a first side to an interior face in the recess and from an opposing face in the recess to a second side of the edge block. An elongated rod is received in the bores and thereby extends across a gap in the recess between the opposing interior faces. A plurality of couplers are used to join a first web to a second web, which webs are positioned side-by-side. Each coupler is disposed within one of the recesses. The couplers are received on the elongated rods in recesses of the respective aligned edge blocks of the webs. Each of the couplers joins at least a portion of the first and second webs together along the aligned edges.

More particularly described, the present invention provides an interior block for use in an interlocking mat of blocks for revetment. The interior block comprises a cast body that defines an upper surface and an opposing bottom surface, a pair of opposing sides, and a pair of opposing ends. A nose extends outwardly from each of the opposing ends. Each of the noses is defined by at least a pair of side walls that extend from the body at an oblique angle to a longitudinal axis of the body to a distal end face. Each nose defines a tunnel therein which extends between the pair of side walls for receiving a revetment cable therethrough. The block being disposed adjacent another of the blocks, is linked to the adjacent block by the revetment cable.

In another aspect, the present invention provides an edge block for use with a plurality of the edge blocks to define on a perimeter edge of a web or mat formed by interlocking a plurality of blocks. The interior and the edge blocks are joined together by a revetment cable that is threaded through tunnels defined in each of said interior and edge blocks. Each of the edge blocks is adapted for engaging a portion of two of the mats together. Each of the edge blocks comprises a cast body which defines an upper surface and an opposing bottom surface, a pair of opposing sides, and a nose end and an opposing recess end. A nose extends from the nose end and is defined by at least a pair of first side walls which extend from the body away from said opposing recess end at an oblique angle to a longitudinal axis of the body. The nose defines a tunnel that extends through the nose between the pair of side walls. The tunnel receives a revetment cable for linking one block to other blocks in a mat of blocks.

The recess end defines a recess having at least a pair of second side walls which extend into the body towards one opposing nose end at an oblique angle to a longitudinal axis of the body to an interior end face. The body defines a pair of coaxial bores which extend from a first of the opposing sides to an interior face of a first one of the second pair of side walls and from an opposing second one of the second pair of side walls to the opposing second side of the body. The bores receive an elongated rod. A first and a second of the edge blocks, being aligned with the recess ends abutting together, are joined together by a coupler which engage the rods exposed in the adjoining recesses of the edge blocks. Adjacent mats of interlocking blocks having the end blocks are thereby connected together.

Objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
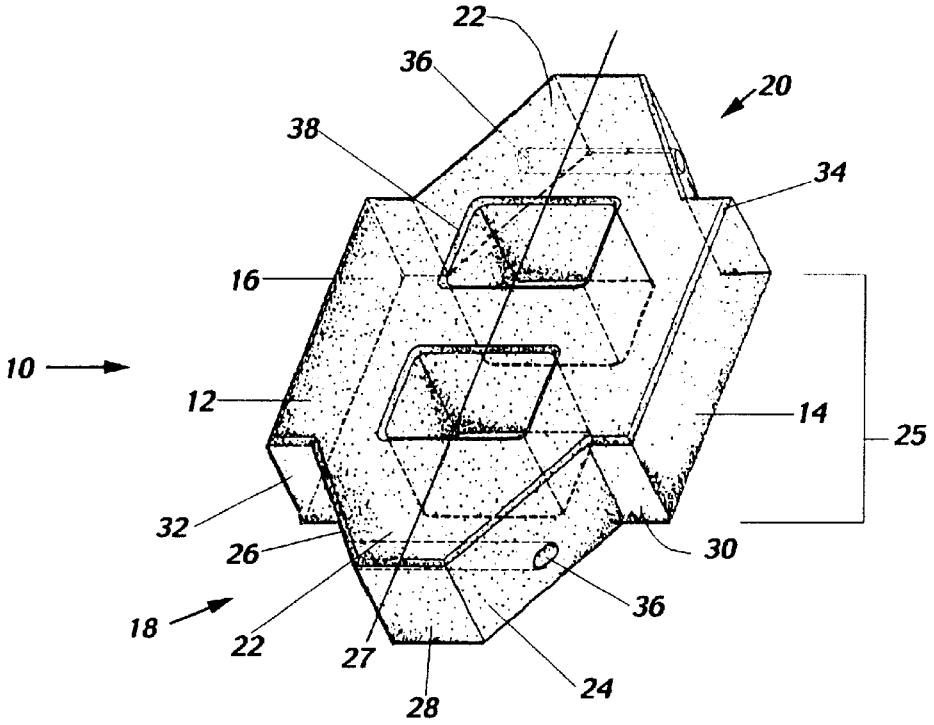
FIG. 1 is a perspective view of a block for use in forming a revetment mat according to the present invention.

Referring now in more detail to the drawings in which like parts have like identifiers, FIG. 1 is a perspective view of a block 10 for use as revetment for a bank of a waterway, and especially with a plurality of such blocks in a revetment mat, as discussed below. The block 10 comprises a cast body defining an upper surface 12 and an opposing bottom surface, a pair of opposing sides 14 and 16, and a pair of opposing ends 18 and 20. A nose 22 extends outwardly from each of the opposing ends 18, 20. The nose 22 is defined by at least a pair of side walls 24 and 26 which extend from a central body 25 at an oblique angle to a longitudinal axis 27 of the body and terminate at a distal end face 28. In the illustrated embodiment, the nose 22 is thicker adjacent the central body 25 than at the distal end face 28. In the illustrated embodiment, the ends 18 and 20 also define a pair of end faces 30 and 32 on opposing sides of the nose 22. A bevel 34 defines a sloped edge between the upper surface 12 and the sides 14, 16 and the end 18, 20.

Each nose 22 defines a tunnel 36 which extends between the pair of side walls 24, 26. The tunnel 36 is intermediate the central body 25 and the distal end face 28. The central body 25 also defines at least one open ended bore 38 which extends between the upper and bottom surfaces. In the illustrated embodiment there are two parallel spaced-apart open ended bores 38.

Figure 2:
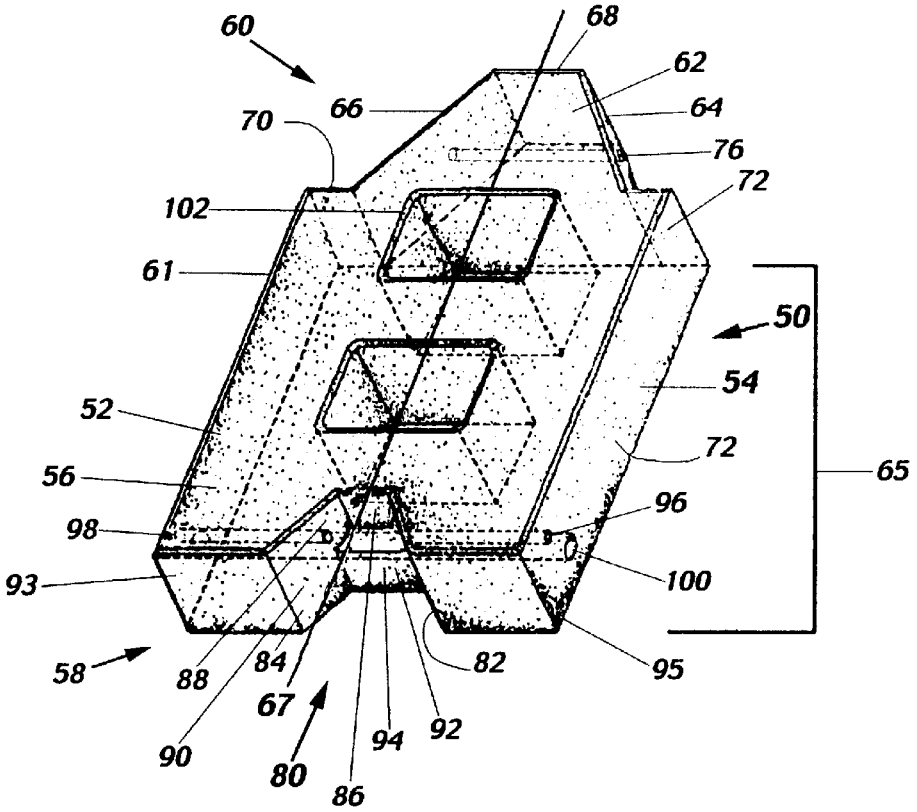
FIG. 2 is a perspective view of an edge block for use on a perimeter of a revetment mat, for facilitating connection of one revetment mat with another, according to the present invention.

FIG. 2 is a perspective view of a block 50 for use as revetment for a bank of a waterway, and especially with a plurality of such blocks in a revetment mat, as discussed below. The illustrated embodiment is particularly used for defining a perimeter row or edge of a revetment mat, as discussed below. The block 50 comprises a cast body defining an upper surface 52 and an opposing bottom surface, a pair of opposing sides 54 and 56, and a pair of opposing ends 58 and 60. A bevel 61 defines a sloped edge between the upper surface 52, and the sides 54, 56 and the ends 58, 60. A nose 62 extends outwardly from the end 60 in a direction away from the opposing end 58. The nose 62 is defined by at least a pair of side walls 64 and 66 which extend from a central body 65 at an oblique angle to a longitudinal axis 67 of the body and terminate at a distal end face 68. In the illustrated embodiment, the nose 62 is thicker adjacent the central body 65 than at the distal end face 68, so that the side walls 64, 66 define converging angles. In the illustrated embodiment, the end 60 also defines a pair of end faces 70 and 72 on opposing sides of the nose 22. The nose 22 further defines a tunnel 76 which extends between the pair of side walls 64, 66. The tunnel 76 is intermediate the central body 65 and the distal end face 68.

The opposing end 58 defines a recess 80 intermediate the sides 54 and 56. The recess 80 is defined by at least a pair of side walls 82, 84 that extend from the end 58 into the body towards the opposing end 60 at an oblique angle relative to the longitudinal axis 67 of the body. The side walls 82, 84 terminate at an interior end face 86. In the illustrated embodiment, the side walls 82, 84 define converging angles. In the illustrated embodiment, the end face 86 is defined by a first portion 88 and a second portion 90. The first portion 88 is relatively deeper into the body than is the second portion 90. The second portion 90 is defined by a land 92 that protrudes outwardly from the first interior portion 88 of the end face 86. The land 92 includes a surface 94 that defines a ledge extending from the first portion 88.

The recess 80 thereby defines a pair of lands 93, 95 in the body. Each land 93, 95 defines a tunnel 96, 98 therethrough. The tunnel 96 extends from the side wall 54 to the interior face of the side wall 82. The tunnel 98 is coaxial with the tunnel 96, and extends from the interior face of the opposing side wall 84 to the side wall 56. As discussed below, the tunnels 96, 98 receive a rod therethrough, which rod extends through a gap defined by the recess 80 and the surface 94 of the land 92.

The block 50 also defines a second tunnel 100 that extends between the opposing sides 54 and 56 through the land 92. The tunnel 100 is preferably parallel to the tunnel 76 in the nose 62.

The central body 65 also defines at least one open-ended bore 102 which extends between the upper and bottom surfaces. In the illustrated embodiment there are two parallel, spaced-apart, open-ended bores 102.

Figure 3:
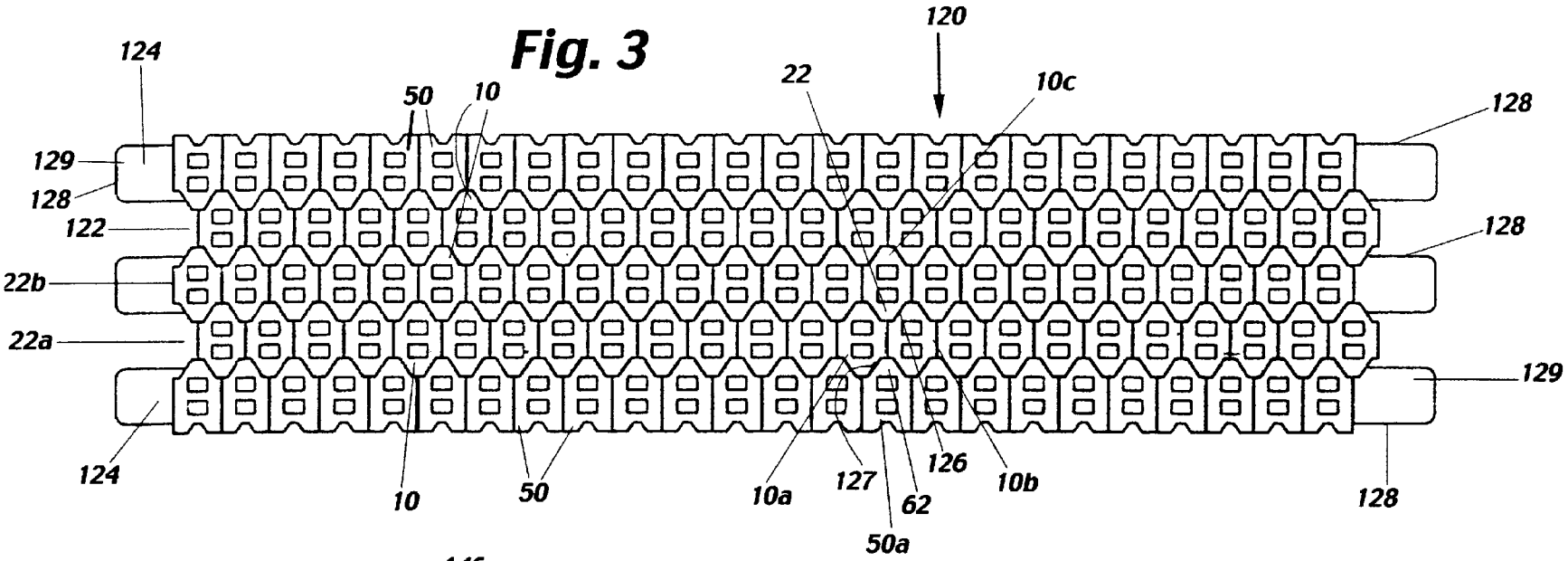
FIG. 3 is a plan view of a revetment mat formed using the blocks illustrated in FIGS. 1 and 2.

FIG. 3 is a plan view of an elongated web (or revetment mat) 120 which is assembled using a plurality of the blocks 10 and 50 illustrated in FIGS. 1 and 2. The term "web" is used to describe the ribbon-like mat which has staggered rows 122 of the blocks 10 and side edge rows 124 of the blocks 50. The mechanical interlocking relationships between the blocks 10 and 50 is illustrated by the following discussion. The blocks 10 and 50 are positioned in an abutting arrangement whereby a pair of the blocks 10*a*, 10*b* positioned side-by-side in the row 122*a* define a notch 126 for receiving the nose 22 of a block 10*c* in the adjacent staggered row 122*b*. Similarly, the adjacent blocks 10*a*, 10*b* define a notch 127 for receiving the nose 62 of the edge block 50*a* in the row 124*a*. The blocks 10, 50 in the web 122 are interconnected by revetment cables 128 which pass through the aligned tunnels 36 in the blocks 10 and the tunnels 76 and 100 in the blocks 50. In the illustrated embodiment, the cables 128 extend outwardly as loops 129 at the distal longitudinal ends of the web 120, for a purpose discussed below.

In the illustrated embodiment, the blocks 10 are used to define three staggered interior rows 122 and the blocks 50 define the two staggered edge rows 124. The resulting web 120 is readily handled by heavy equipment such as cranes and tractors engaging the loops 129 at the longitudinal ends 130. Accordingly, the web 120 defines a ribbon of revetment blocks for handling and positioning by heavy equipment on a bank of a waterway. The web 120 is illustrated with a length greater than the width, but it is to be appreciated that webs may be produced in any convenient shape, including webs having different number of rows 122 or blocks in the rows, so that the shape is not rectangular. The blocks 10 and 50 may be produced by conventional precast concrete block manufacturing equipment and techniques.

Figure 4:
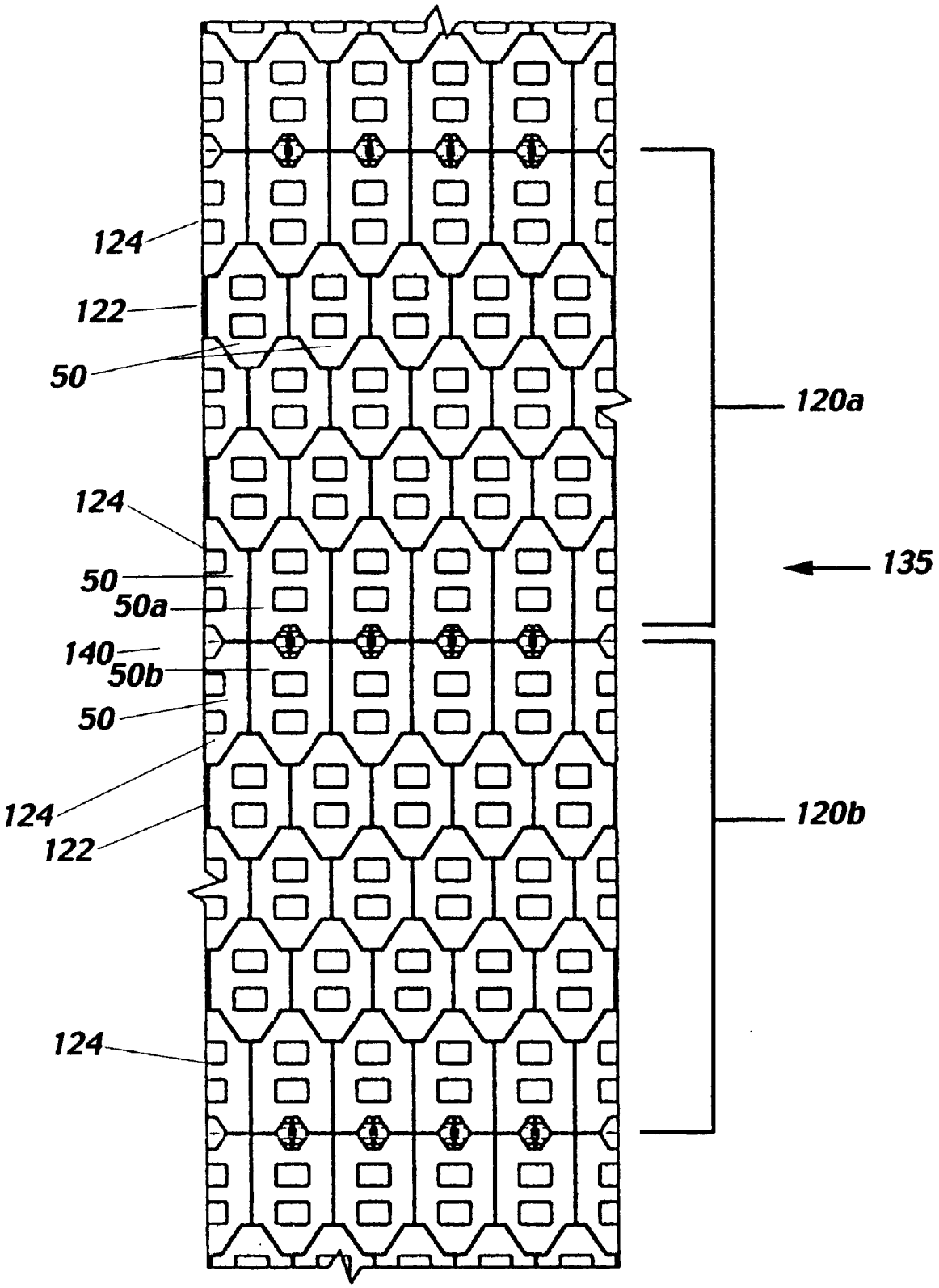
FIG. 4 is a partial view of a pair of revetment mats illustrated in FIG. 3 joined together along aligned perimeter edge portions thereof.

FIG. 4 is a detailed partial view of revetment webs 120 illustrated in FIG. 3 positioned side-by-side to define a larger revetment mat 135. In particular, FIG. 4 illustrates portions of two webs 120*a* and 120*b* aligned side-by-side in the mat 135. The adjacent revetment webs 120*a*, 120*b* are joined together along aligned perimeter edge portions generally designated 140 where the ends 58 of the edge blocks 50 of the adjacent webs abut together.

Figure 5:
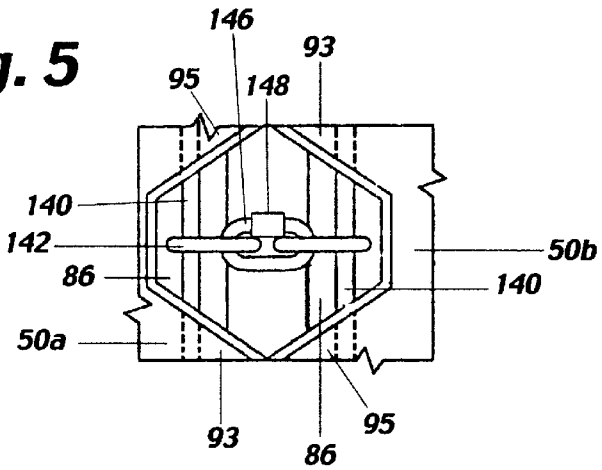
FIG. 5 is a detailed plan view of the connection of one edge block illustrated in FIG. 2 in a mat illustrated in FIG. 3 with an aligned edge block in a second mat.
Figure 6:
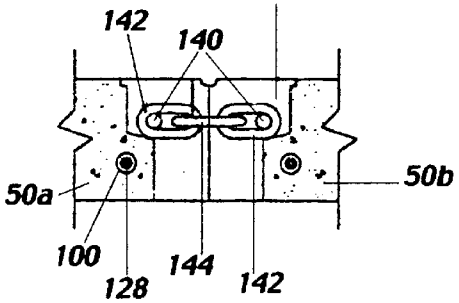
FIG. 6 is a detailed elevational side view of the connection of one edge block in a mat with an aligned edge block in a second mat, shown in FIG. 5.

The connection of the articulating concrete block web 120*a* to the mat 120*b* is best illustrated in FIGS. 5 and 6. FIG. 5 is a detailed plan view of the connection of one edge block 50*a* in the mat 120*a* with an aligned edge block 50*b* in the mat 120*b*. FIG. 6 is a partial side elevational view of the connection of the edge block 50*a* in the web 120*a* with an aligned edge block 50*b* in the adjacent web 120*b*. A rod 140 extends through the aligned coaxial tunnels 96, 98 of the blocks 50. The rod 140 accordingly passes through the recess 80. In a preferred embodiment, the rod 140 is fiberglass. As the rod 140 is moved through the gap defined by the recess 80, the rod 140 receives a link 142, such as a chain link. The links 142 of adjacent, abutting blocks 50 are interconnected by a connecting link 144. In the illustrated embodiment, the connecting link 144 is a C-shaped link having threaded ends 146 which receive a threaded tube or sleeve 148 for closing the C-shaped link.

The mat 135 of the present invention comprises at least two webs 120*a*, 120*b* joined together at aligned edges 140. The webs 120 are formed by interconnecting a plurality of the interior blocks 10 and a plurality of edge blocks 50 that define the side edges of the web. The revetment cable 128 interlocks the interior and edge blocks 10, 50 together by threading the cable through the tunnels 36 in the blocks 10 and the tunnels 76 and 100 in the blocks 50. Interior blocks 50 are positioned side-by-side in staggered rows 122, whereby the tunnels 36 align with tunnels in adjacent blocks. The edge blocks 50 interlink by connecting the tunnels 76 with the coaxially aligned tunnels 36 in the adjacent block 10. The blocks 50 also interconnect to adjacent blocks 50 by threading the revetment cable 120 through the coaxially aligned tunnels 100 in the ends 58. As best illustrated in FIG. 3, the loops 129 defined by the cables 128 of the longitudinal ends 130 of the web 120 are used by cranes or tractors for placing the revetment web 120 on a bank of a waterway.

With reference to FIG. 4, a second web 120*b* is positioned beside the web 120*a* whereby the ends 58 of the edge blocks 50 in the webs are aligned with ends in the adjacent web. The rod 140 is then slidingly inserted through the aligned coaxial tunnels 96 and 98 of the respective blocks 50. As the leading end of the rod 140 passes through the gap in the recess 80, a link 142 is held within the recess 80 so that the end of the rod 140 passes through the link and into the tunnel 98. This is repeated for each block 50 in the webs 120.

The adjacent webs 120*a* and 120*b* are then joined together by interconnecting the links 142 with a coupler or connecting link 144. In the illustrated embodiment, the coupler is the openable C-shaped link 144. The threaded sleeve 148 is unscrewed from the threaded end 146 to open a gap in the link 144. The links 142 pass through the opened gap with a twisting rotational movement of the link 144. The threaded sleeve 148 is thereafter rotated in order to close the open link 144. One of the C-shaped links or couplers is received by each of the aligned pairs of blocks 50*a* and 50*b*. The recesses 80 provide a readily accessible and convenient opening for securing portions of the adjacent webs 120 together. Securing the webs 120 together forms the larger revetment mat 135 for protecting the bank of a waterway from erosion, while maintaining the integrity of the mat such that the aligned edges 140 of the webs 120*a*, 120*b* are not subject to movement or displacement by erosion. In an alternate embodiment, the adjacent blocks 50 are joined together by cables and clamps. The openings 38 in the blocks 10 and the openings 102 in the blocks 50 accumulate dirt and other material, and thereby faciliate the merger of the revetment mat 135 with the bank.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. An edge block for use with a plurality of said edge blocks on a perimeter edge of a mat formed with a plurality of interlocking interior blocks, said interior and edge blocks joined together by a revetment cable threaded through tunnels defined in each of said interior and edge blocks, each of said edge blocks adapted for engaging a portion of a pair of said mats together, said edge block comprising a cast body defining:

an upper surface and an opposing bottom surface, a pair of opposing sides, and a nose end and an opposing recess end;

a nose extending from said nose end and defined by at least a pair of first side walls extending from the body away from said opposing recess end at an oblique angle to a longitudinal axis of the body;

said nose defining a tunnel therethrough and extending between said pair of side walls, for receiving a revetment cable therethrough for linking said block to another block in a mat of blocks;

a recess defined in said recess end by at least a pair of second side walls extending into the body towards said opposing nose end at an oblique angle to a longitudinal axis of the body to an interior end face;

the body defining a pair of coaxial bores which extend from a first of the opposing sides to an interior face of a first one of the second pair of side walls and from an opposing second one of the second pair of side walls to the opposing second side of the body, for receiving therethrough an elongated rod, whereby a first and a second of the edge blocks, being aligned with the recess ends abutting together, are joined together by a coupler which engage the rods exposed in the adjoining recesses of the edge blocks, whereby adjacent mats of interlocking blocks having said end blocks, are connected together.

2. The edge block as recited in claim 1, wherein said first side walls converge together from the nose end to a distal end face.

3. The edge block as recited in claim 1, wherein said second side walls converge together from said recess end to the interior end face.

4. The edge block as recited in claim 3, wherein said first side walls converge together from the nose end to a distal end face.

5. The edge block as recited in claim 4, wherein said first and second pairs of side wall converge at substantially similar acute angles to a longitudinal axis of the body, whereby the nose of a first one of said blocks is conformingly received within the recess of a second of said blocks.

6. The edge block as recited in claim 1, further comprising at least one open-ended bore extending between the upper and bottom surfaces.

7. The edge block as recited in claim 1, further comprising a land protruding outwardly from the interior end face of the recess; and the body further defining a second tunnel extending between the opposing sides and through the land, for receiving a portion of a revetment cable for interlocking the edge block with other blocks in a revetment mat.

8. A revetment mat for lining waterways, comprising:

at least two webs joined together at aligned edges thereof; each web comprising:

a plurality of (a) interior blocks disposed side-by-side and (b) a plurality of edge blocks defining a perimeter edge of said web, said interior and edge blocks interlinked together by threading a revetment cable through tunnels defined therein;

(a) each of said interior blocks comprising a cast body defining:

an upper surface and an opposing bottom surface, a pair of opposing sides, and a pair of opposing ends;

a nose extending outwardly from each of the opposing ends and defined by at least a pair of side walls extending from the body at an oblique angle to a longitudinal axis of the body to a distal end face; and in each nose, a tunnel extending between said pair of side walls, for receiving a revetment cable therethrough, whereby said interior block, being disposed adjacent another of said blocks, is linked thereto the revetment cable;

(b) each of said edge blocks comprises a cast body defining:

an upper surface and an opposing bottom surface, a pair of opposing sides, and a nose end and an opposing recess end;

a nose extending from said nose end and defined by at least a pair of second side walls extending from the body away from said opposing recess end at an oblique angle to a longitudinal axis of the body;

said nose defining a tunnel therethrough extending between said pair of side walls, for receiving a revetment cable therethrough for linking said edge block to an adjacent interior or edge block in a mat of blocks;

a recess defined in said recess end by at least a pair of third side walls extending into the body towards said opposing nose end at an oblique angle to a longitudinal axis of the body to an interior end face;

the body defining a pair of coaxial bores which extend from a first of the opposing sides to an interior face of a first one of the third pair of side walls and from an opposing second one of the third pair of side walls to the opposing second side of the body, for receiving therethrough an elongated rod for connecting aligned end blocks of different webs together with a coupler;

(c) a revetment cable threadingly extending through the tunnels defined in the interior and edge blocks, whereby a first web of blocks is formed; and a plurality of couplers, each received on a respective one of the rods in the recess of the edge blocks in a first web and received on a respective one of the rods in the recesses of the edge blocks in a second web positioned adjacent the first web, whereby each of the couplers connects a portion of the perimeter of the first web to a portion of the perimeter of the second web.

9. The revetment mat as recited in claim 8, wherein the side walls of each of the interior blocks define converging faces, whereby each of the noses, in plan view, is thicker adjacent the body than at the distal end face.

10. The revetment mat as recited in claim 8, wherein each interior block further comprises at least one open-ended bore extending between the upper and bottom surfaces.

11. The revetment mat as recited in claim 8, wherein said second side walls of each of said edge blocks converge together from the nose end to the distal end face.

12. The revetment as recited in claim 8, wherein said third side walls of each of said edge blocks converge together from said recess end to the interior end face.

13. The revetment mat as recited in claim 12, wherein said second side walls of each of said edge blocks converge together from the nose end to the distal end face.

14. The revetment mat as recited in claim 13, wherein said first and second pairs of side walls converge at substantially similar angles, whereby the nose of one of said edge blocks is conformingly received within a gap defined between the noses of a pair of said interior blocks.

15. The revetment mat as recited in claim 8, further comprising at least one open-ended bore in each of said edge blocks and extending between the upper and bottom surfaces.

16. The revetment mat as recited in claim 8, wherein each edge block further comprises a land protruding laterally outwardly from the interior end face of the recess; and the body of the edge block further defining a tunnel extending between opposing sides thereof and through the land, for receiving the revetment cable therethrough.

17. A revetment mat, comprising:

at least two webs joined together at aligned edges thereof, each web comprising:

a plurality of (a) interior blocks disposed side-by-side and (b) a plurality of edge blocks defining a perimeter edge of said web, said interior and edge blocks interlinked together by threading a revetment cable through tunnels defined therein;

each of said edge blocks defining a recess in a side portion thereof and further defining a pair of coaxial bores which extend from a first side to an interior face in the recess and from an opposing face in the recess to a second side of the edge block; and an elongate rod received in the bores and thereby extending across a gap in the recess between the opposing interior faces thereof; and a plurality of couplers, each one disposed within the recesses of edge blocks disposed adjacent each other in a first web and a second web, said couplers received on the elongate rod of one of edge blocks of the first web and on the elongate rod of one of the edge blocks in the second web positioned adjacent said first web, whereby each said coupler joins at least a portion of the first and second webs together along aligned edges thereof.

18. The revetment mat as recited in claim 17, wherein the coupler comprises:

a link received on the elongated rod in the recess; and a closable link that engages the links in the pair of adjacent edge blocks.

19. The revetment mat as recited in claim 18, wherein the closeable link comprises a C-shaped link with a movable member for selectively closing the closable link.

20. The revetment mat as recited in claim 19, wherein the movable member comprises a threaded sleeve on the C-shaped link which threadingly engages a threaded portion of the closable link.

* * * * *